US011160384B2

(12) United States Patent
Zhu et al.

(10) Patent No.: US 11,160,384 B2
(45) Date of Patent: Nov. 2, 2021

(54) FOLDING BEDSTEAD AND FOLDING BED

(71) Applicant: ZHEJIANG SUNSHINE LEISURE PRODUCTS CO., LTD., Jinghua (CN)

(72) Inventors: Xiaohui Zhu, Jinhua (CN); Xuefeng Zheng, Jinhua (CN); Zhihao Zheng, Jinhua (CN)

(73) Assignee: ZHEJIANG SUNSHINE LEISURE PRODUCTS CO., LTD., Jinhua (CN)

( * ) Notice: Subject to any disclaimer, the term of this patent is extended or adjusted under 35 U.S.C. 154(b) by 102 days.

(21) Appl. No.: 16/583,855

(22) Filed: Sep. 26, 2019

(65) Prior Publication Data

US 2021/0037984 A1 Feb. 11, 2021

(30) Foreign Application Priority Data

Aug. 8, 2019 (CN) ..... 201921282509.4

(51) Int. Cl.
*A47C 17/70* (2006.01)

(52) U.S. Cl.
CPC ..... *A47C 17/70* (2013.01)

(58) Field of Classification Search
CPC ..... A47C 17/70; A47C 17/68
See application file for complete search history.

(56) References Cited

U.S. PATENT DOCUMENTS 3,108,291 A * 10/1963 Eason ..... A47C 17/68 5/111
3,852,837 A * 12/1974 Eakins ..... A47C 17/58 5/155
3,967,330 A * 7/1976 Zawadowsky ..... A47C 19/122 5/114
2008/0256747 A1* 10/2008 Chang ..... A47C 17/68 16/239

FOREIGN PATENT DOCUMENTS

CN 201067222 Y * 6/2008 ..... A47C 17/68
CN 203153128 U 8/2013

* cited by examiner

*Primary Examiner* — David R Hare
*Assistant Examiner* — Adam C Ortiz
(74) *Attorney, Agent, or Firm* — Muncy, Geissler, Olds and Lowe, P.C.

(57) ABSTRACT

A folding bedstead and a folding bed comprising same. The folding bedstead comprises a bed surface support frame and a support leg frame. The bed surface support frame comprises intermediate connecting pieces and support units symmetrically arranged at two ends of the intermediate connecting pieces. Each support unit comprises straight connecting tubes pivoted to the intermediate connecting pieces and a U-shaped bed frame tube pivoted at outer ends of the straight connecting tubes. The bed surface support frame is a closed planar frame in an unfolded state. The leg support frame comprises an intermediate leg frame, lateral leg frames, and outer leg frames, wherein the intermediate leg frame is arranged on the intermediate connecting pieces, the lateral leg frames are arranged on the straight connecting tubes in a folding manner, and the outer leg frames are arranged on the U-shaped bed frame tubes in a folding manner.

14 Claims, 8 Drawing Sheets

FOLDING BEDSTEAD AND FOLDING BED

BACKGROUND OF THE INVENTION

1. Technical Field

The invention relates to the field of daily life, in particular to folding bedstead which has high support strength and a small folded size, and a folding bed provided with the folding bedstead.

2. Description of Related Art

Folding beds are convenient to store and transfer, thereby being very popular with people. The folding beds are also portable and foldable, thereby being generally used outdoors or in offices to meet the requirements.

Folding beds on the current market are not provided with U-shaped bed frame tubes and have two sides connected through fabric without rigid support, and consequentially, the fabric may be recessed inwards after long-term usage, which in turn causes discomfort to the head and feet of users and affects the usage effect, such as a folding bed disclosed in Chinese Utility Model Patent Application No. 201320116055.X. Such folding beds have too many tubes, are complex, and still have a large size after being folded, thereby occupying a large space and being inconvenient to store.

BRIEF SUMMARY OF THE INVENTION

In view of this, the objective of the invention is to provide a folding bedstead having high support strength and a small folded size, and a folding bed provided with the folding bedstead.

The technical solution adopted by the invention to fulfill the above objective is as follows:

A folding bedstead comprises a bed surface support frame and a support leg frame, wherein the bed surface support frame comprises intermediate connecting pieces and support units symmetrically arranged at two ends of the intermediate connecting pieces, each support unit comprises straight connecting tubes pivoted to the intermediate pieces and a U-shaped bed frame tube pivoted to outer ends of the straight connecting tubes, and the bed surface support frame is a closed planar frame in an unfolded state; and the support leg frame comprises an intermediate leg frame, lateral leg frames, and outer leg frames, the intermediate leg frame is arranged on the intermediate connecting pieces, the lateral leg frames are arranged on the straight connecting tubes in a folding manner, and the outer leg frames are arranged on the U-shaped bed frame tubes in a folding manner.

Furthermore, the intermediate leg frame, the lateral leg frames, and the outer leg frames are of a U-shaped structure and each comprise two vertical tubes having ends connected to the bed surface support frame and a horizontal tube connected between the two vertical tubes and supported on the ground.

Furthermore, support connecting rods are connected between middle parts of the two vertical tubes of the intermediate leg frame and between middle parts of the two vertical tubes of each lateral leg frame.

Furthermore, each intermediate connecting piece has an inverted U-shaped section and is provided with lateral openings formed in the ends of the intermediate connecting piece and a lower opening facing downwards, the straight connecting tubes at the two ends of the intermediate connecting pieces stretch into the intermediate connecting pieces via the lateral openings to be pivoted to the intermediate connecting pieces, and the intermediate leg frame stretches into the intermediate connecting pieces via the lower openings to be fixed to the intermediate connecting pieces.

Furthermore, rotary bases are pivoted to the straight connecting tubes, and the lateral leg frames are fixedly connected to the rotary bases. The folding bedstead further comprises first connecting pieces, and two ends of each first connecting piece are respectively pivoted to one lateral leg frame and the corresponding U-shaped bed frame tube. When the bed surface support frame is unfolded, a stable triangular fixing structure is formed by the first connecting pieces, the lateral leg frames, and the U-shaped bed frame tubes.

Furthermore, the straight connecting tubes are pivoted to the U-shaped bed frame tubes through rotary connecting assemblies. Each rotary connecting assembly is composed of two connecting components which are of a 7-shaped structure and are arranged oppositely, wherein one outer ends of the two connecting components are pivoted together, and the other outer ends of the two connecting components are respectively connected with one straight connecting tube and the corresponding U-shaped bed frame tube.

Furthermore, the ends of the connecting components of the rotary connecting assemblies are inserted into the straight connecting tubes and/or the U-shaped bed frame tubes to be fixed.

Furthermore, the outer leg frames are pivoted to the U-shaped bed frame tubes, and lock devices are arranged between the outer leg frames and the U-shaped bed frame tubes to lock the relative positions of the outer leg frames and the U-shaped bed frame tubes.

Furthermore, each lock device comprises a sleeve body provided with a sleeve hole, an inner slider, an elastic piece and a second connecting piece, wherein the sleeve body is further provided with an inner cavity which is perpendicular to the sleeve hole and is provided with an opening, the inner slider is arranged in the inner cavity in a sliding fit manner and is provided with a long slot corresponding to the sleeve hole and a bolt stretching into the long slot, one outer leg frame slidably penetrates through the sleeve hole of the sleeve body and the long slot of the inner slider, two ends of the second connecting piece are respectively pivoted to the sleeve body and the corresponding U-shaped bed frame tube, the outer leg frame is provided with a pin hole, and the elastic piece is arranged in the inner cavity; and when the sleeve body slides to make the bolt of the inner slider correspond to the pin hole of the outer leg frame, the elastic piece drives the inner slider to slide, and then the bolt is inserted into the pin hole of the outer leg frame, so that the relative positions of the outer leg frame and the U-shaped bed frame tube are locked.

A folding bed comprises a folding bedstead and a bed surface laid on the folding bedstead. The folding bedstead comprises a bed surface support frame and a support leg frame, wherein the bed surface support frame comprises intermediate connecting pieces and support units symmetrically arranged at two ends of the intermediate connecting pieces, each support unit comprises straight connecting tubes pivoted to the intermediate pieces and a U-shaped bed frame tube pivoted to outer ends of the straight connecting tubes, and the bed surface support frame is a closed planar frame in an unfolded state; and the support leg frame comprises an intermediate leg frame, lateral leg frames, and outer leg frames, the intermediate leg frame is arranged on the intermediate connecting pieces, the lateral leg frames are arranged on the straight connecting tubes in a folding manner, and the outer leg frames are arranged on the U-shaped bed frame tubes in a folding manner.

Furthermore, the intermediate leg frame, the lateral leg frames, and the outer leg frames are of a U-shaped structure and each comprise two vertical tubes having ends connected to the bed surface support frame and a horizontal tube connected between the two vertical tubes and supported on the ground.

Furthermore, support connecting rods are connected between middle parts of the two vertical tubes of the intermediate leg frame and between middle parts of the two vertical tubes of each lateral leg frame.

Furthermore, each intermediate connecting piece has an inverted U-shaped section and is provided with lateral openings formed in the ends of the intermediate connecting piece and a lower opening facing downwards, the straight connecting tubes at the two ends of the intermediate connecting pieces stretch into the intermediate connecting pieces via the lateral openings to be pivoted to the intermediate connecting pieces, and the intermediate leg frame stretches into the intermediate connecting pieces via the lower openings to be fixed to the intermediate connecting pieces.

Furthermore, rotary bases are pivoted to the straight connecting tubes, and the lateral leg frames are fixedly connected to the rotary bases. The folding bedstead further comprises first connecting pieces, and two ends of each first connecting piece are respectively pivoted to one lateral leg frame and the corresponding U-shaped bed frame tube. When the bed surface support frame is unfolded, a stable triangular fixing structure is formed by the first connecting pieces, the lateral leg frames, and the U-shaped bed frame tubes.

Furthermore, the straight connecting tubes are pivoted to the U-shaped bed frame tubes through rotary connecting assemblies. Each rotary connecting assembly is composed of two connecting components which are of a 7-shaped structure and are arranged oppositely, wherein one outer ends of the two connecting components are pivoted together, and the other outer ends of the two connecting components are respectively connected with one straight connecting tube and the corresponding U-shaped bed frame tube.

Furthermore, the ends of the connecting components of the rotary connecting assemblies are inserted into the straight connecting tubes and/or the U-shaped bed frame tubes to be fixed.

Furthermore, the outer leg frames are pivoted to the U-shaped bed frame tubes, and lock devices are arranged between the outer leg frames and the U-shaped bed frame tubes to lock the relative positions of the outer leg frames and the U-shaped bed frame tubes.

Furthermore, each lock device comprises a sleeve body provided with a sleeve hole, an inner slider, an elastic piece and a second connecting piece, wherein the sleeve body is further provided with an inner cavity which is perpendicular to the sleeve hole and is provided with an opening, the inner slider is arranged in the inner cavity in a sliding fit manner and is provided with a long slot corresponding to the sleeve hole and a bolt stretching into the long slot, one outer leg frame slidably penetrates through the sleeve hole of the sleeve body and the long slot of the inner slider, two ends of the second connecting piece are respectively pivoted to the sleeve body and the corresponding U-shaped bed frame tube, the outer leg frame is provided with a pin hole, and the elastic piece is arranged in the inner cavity; and when the sleeve body slides to make the bolt of the inner slider correspond to the pin hole of the outer leg frame, the elastic piece drives the inner slider to slide, and then the bolt is inserted into the pin hole of the outer leg frame, so that the relative positions of the outer leg frame and the U-shaped bed frame tube are locked.

By adoption of the technical solution, the invention has the following beneficial effects:

The U-shaped bed frame tubes are arranged at the outer ends of the bed surface support frame, so that the bed surface support frame can be unfolded to form a closed planar frame and has two rigidly-supported ends, and thus, the support strength is good. Meanwhile, the two ends of the bed surface support frame are symmetrical with the intermediate connecting pieces as the center and are pivoted to the intermediate connecting pieces, so that the bed surface support frame can be folded repeatedly. The lateral leg frames used for supporting the straight connecting tubes and the outer leg frames used for supporting the U-shaped bed frame tubes are also foldable, so that the folding bedstead has a smaller folded size, occupies a small area, and is more convenient to carry.

DETAILED DESCRIPTION OF THE INVENTION

Figure 1:
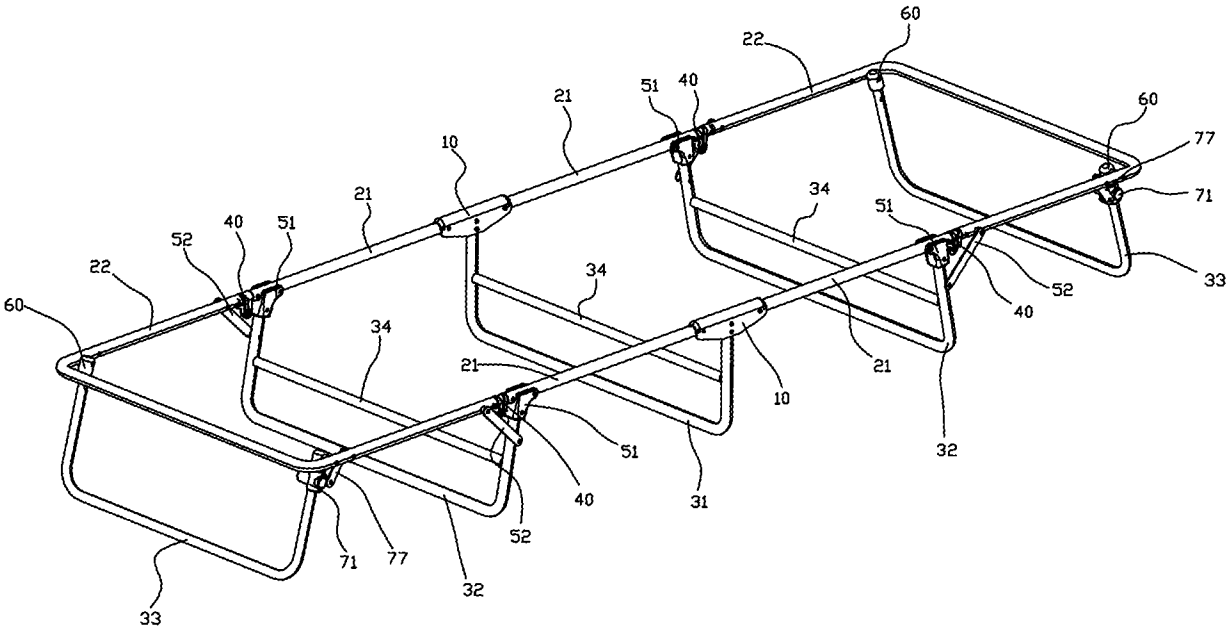
FIG. 1 is a structural diagram of a folding bedstead in an unfolded state in one embodiment.

The accompanying drawings are provided for a further description of the embodiments of the invention. These drawings are part of the contents of this disclosure and are mainly used to illustrate the embodiments and to explain the operating principle of the embodiments in cooperation with the relevant contents in the specification. With reference to these contents, those ordinarily skilled in the art can appreciate other possible implementations and advantages of the invention. The components in the drawings are not drawn to scale, and similar reference signs generally represent similar components.

The invention is further described below with reference to the accompanying drawings and specific implementations.

Referring to FIG. 1-FIG. 12, this embodiment provides a folding bedstead. The folding bedstead comprises a bed surface support frame and a support leg frame. The bed surface support frame comprises intermediate connecting pieces 10 and support units symmetrically arranged at two ends of the intermediate connecting pieces 10. Each support unit comprises straight connecting tubes 21 pivoted to the intermediate connecting pieces 10 and a U-shaped bed frame tube 22 pivoted to outer ends of the straight connecting tubes 21. The bed surface support frame is a closed planar frame in an unfolded state. Particularly, the bed surface support frame comprises two intermediate connecting pieces 10, and each of the support units at the two ends is provided with two straight connecting tubes 21 respectively pivoted to the two intermediate connecting pieces 10 and a U-shaped bed frame tube 22 having two ends respectively pivoted to outer ends of the two straight connecting tubes 21, so that the bed surface support frame is a closed planar frame in the unfolded state.

The support leg frame comprises an intermediate leg frame 31, lateral leg frames 32, and outer leg frames 33, wherein the intermediate leg frame 31 is arranged on the intermediate connecting pieces 10, the lateral leg frames 32 are arranged on the straight connecting tubes 21 in a folding manner, and the outer leg frames 33 are arranged on the U-shaped bed frame tubes 22 in a folding manner.

The U-shaped bed frame tubes 22 are arranged at the outer ends of the bed surface support frame, so that the bed surface support frame can be unfolded to form a closed planar frame and has two rigidly-supported ends, and thus, the support strength is good. Meanwhile, the two ends of the bed surface support frame are symmetrical with the intermediate connecting pieces 10 as the center and are pivoted to the intermediate connecting pieces 10, so that the bed surface support frame can be folded repeatedly. As shown in FIG. 2-FIG. 5, the bed surface support frame is folded around pivot points of the U-shaped bed frame tubes 22 at the two ends and the straight connecting tubes 21 first and is then folded around pivot points of the straight connecting tubes 21 and the intermediate connecting pieces 10, and in this way, the bed surface support frame is completely folded and stored; and the lateral leg frames 32 used for supporting the straight connecting tubes 21 and the outer leg frames 33 used for supporting the U-shaped bed frame tubes 22 are also foldable, so that the folding bedstead has a smaller folded size, occupies a small area, and is more convenient to carry.

Furthermore, in this embodiment, the intermediate leg frame 31, the lateral leg frames 32, and the outer leg frames 33 are of a U-shaped structure and each comprise two vertical tubes and a horizontal tube connected between the two vertical tubes, wherein the ends of the vertical tubes are connected to the bed surface support frame, and the horizontal tube is stably supported on the ground. Particularly, during assembly, the two vertical tubes of the intermediate leg frame 31 are connected to the two intermediate connecting pieces 10, the two vertical tubes of each lateral leg frame 32 are connected to the two straight connecting tubes 21 of one support unit, the two vertical tubes of each outer leg frame 33 are connected to one U-shaped bed frame tube 33. The leg frames of the U-shaped structure are simple in structure, have a high support capacity, and occupy a small space after being folded. Clearly, in other embodiments, the intermediate leg frame 31, the lateral leg frames 32, and/or the outer leg frames 33 can be other support structures.

Particularly, the vertical tubes and the horizontal tube of each leg frame are integrally connected and are integrally formed by a straight tube through stamping and bending, thereby being easy to manufacture and high in efficiency. Clearly, in other embodiments, each leg frame can also be formed by a plurality of straight tubes which are assembled together.

Furthermore, in this embodiment, support connecting rods 34 are connected between middle parts of the two vertical tubes of the intermediate leg frame 31 and between middle parts of the two vertical tubes of each lateral leg frame 32. The intermediate leg frame 31 and the lateral leg frames 32 which serve as main support leg frames are additionally provided with the support connecting rods 34, so that better stabilization and support effects are realized. Clearly, in other embodiments, the support connecting rods 34 are arranged on the intermediate leg frame 31, the lateral leg frames 32, and the outer leg frames 33, or only one leg frame is provided with the support connecting rod 34.

Furthermore, in this embodiment, each intermediate connecting piece 10 has an inverted U-shaped section and is provided with lateral openings (not shown) formed in the ends and a lower opening (not shown) facing downwards. The straight connecting tubes 21 at the two ends of the intermediate connecting pieces 10 stretch into the intermediate connecting pieces 10 via the lateral openings to be pivoted to the intermediate connecting pieces 10, and the intermediate leg frame 31 stretches into the intermediate connecting pieces 10 via the lower openings to be fixed to the intermediate connecting pieces 10, so that the intermediate connecting pieces 10 are connected with the straight connecting tubes 21 and the intermediate leg frame 31. The inverted U-shaped structure can prevent the straight connecting tubes 21 from being excessively unfolded, and particularly, when the straight connecting tubes 21 at the two ends of each intermediate connecting piece 10 are unfolded to the same plane, the straight connecting tubes 21 are limited by the intermediate connecting piece 10 to be kept on the same plane in the unfolded state.

Particularly, the support units at the two ends are synchronously folded inwards, so that the intermediate leg frame 31 of the U-shaped structure in the middle does not need to be folded and is fixedly connected with the intermediate connecting pieces 10 directly, so that fixation after unfolding is simplified. Clearly, in other embodiments, the intermediate connecting pieces 10 can adopt other structures to realize corresponding connection, and the intermediate leg frame 31 can be fixed or pivoted to the intermediate connecting pieces 10 according to actual folding requirements.

Particularly, in this embodiment, the intermediate leg frame 31 is inserted into the intermediate connecting pieces 10, the intermediate leg frame 31 and each intermediate connecting piece 10 are respectively provided with two sets of corresponding connecting holes (not shown), and plug pins (not shown) are inserted into the two sets of corresponding connecting holes to realize fixed connection of the intermediate leg frame 31 and the intermediate connecting pieces 10. By adoption of such configuration, one plug pin can be pulled out to pivot the intermediate leg frame 31 to the intermediate connecting pieces 10; and the intermediate leg frame can be fixed or pivoted to the intermediate connecting pieces, and assembly and disassembly are easy and convenient. Clearly, in other embodiments, the intermediate leg frame can also be clamped or welded to the intermediate connecting pieces.

Furthermore, in this embodiment, rotary bases 51 are pivoted to the straight connecting tubes 21, the lateral leg frames 32 are fixedly connected to the rotary bases 51. The folding bedstead further comprises first connecting pieces 52, and two ends of each first connecting piece 52 are respectively pivoted to one lateral leg frame 32 and the corresponding U-shaped bed frame tube 22. When the bed surface support frame is unfolded, the first connecting pieces 52, the lateral leg frames 32, and the U-shaped bed frame tubes 22 form a stable triangular fixing structure to realize stable supporting. When the bed surface support frame is folded or unfolded, the straight connecting tubes 21 and the U-shaped bed frame tubes 22 are folded or unfolded along the pivot points therebetween and synchronously drive the rotary bases 51 and the lateral leg frames 32 through the first connecting pieces 52 to be folded or unfolded, so that linkage is realized, and operation is facilitated. Clearly, in other embodiments, the lateral leg frames 32, and the straight connecting tubes 21 can be folded through other structures.

Furthermore, in this embodiment, the straight connecting tubes 21 are pivoted to the U-shaped bed frame tubes 22 through rotary connecting assemblies 40. Each rotary connecting assembly 40 is composed of two connecting components 41 which are of a 7-shaped structure and are arranged oppositely, wherein one outer ends of the two connecting components 41 are pivoted together through a pivot structure formed by a rotary shaft (not shown) penetrating through pivot holes 411 at the outer ends, and the other outer ends of the two connecting components 41 are respectively connected with one straight connecting tube 21 and the corresponding U-shaped bed frame tube 22. When the bed surface support frame is unfolded, the two connecting components 41 of each rotary connecting assembly 40 back onto and abut against each other to be limited to form a T-shaped structure, so that the straight connecting tubes 21 and the U-shaped bed frame tubes 22 cannot be unfolded anymore and are kept on the same plane in the unfolded state.

Through the structural limitations of the intermediate connecting pieces 10 and the rotary connecting assemblies 40, the bed surface support frame forms a closed planar frame in the unfolded state. Clearly, in other embodiments, other limiting structures can be adopted to maintain the planar frame.

Particularly, the ends of the connecting components 41 of the rotary connecting assemblies 40 are inserted into the straight connecting tubes 21 and/or the U-shaped bed frame tubes 22 to be fixed. Namely, in this embodiment, the ends of the two connecting components 41 of each rotary connecting assembly 40 are respectively inserted into one straight connecting tube 21 and the corresponding U-shaped bed frame tube 22. Furthermore, corresponding connecting through holes are formed in the ends of the connecting components 41 and the straight connecting tubes 21 or the U-shaped bed frame tubes 22 where the ends of the connecting components 41 are inserted (for instance, connecting through holes 412 are formed in the ends of the connecting components 41, and connecting through holes formed in the straight connecting tubes 21 or the U-shaped bed frame tubes 22 are not shown), and fasteners such as rivets penetrate through the connecting through holes to realize fixed connection.

Furthermore, in this embodiment, the outer leg frames 33 are pivoted to the U-shaped bed frame tubes 22, and lock devices are arranged between the outer leg frames 33 and the U-shaped bed frame tubes 22 to lock the relative positions of the outer leg frames 33 and the U-shaped bed frame tubes 22. Particularly, the bed surface support frame and the outer leg frames 33 are unfolded first, and when rotating to supporting positions, the outer leg frames 33 are locked by the lock devices to fix the relative positions of the outer leg frames 33 and the U-shaped bed frame tubes 22, so that the outer leg frames are firmly supported and are not prone to moving.

Particularly, end caps 60 are pivoted to the U-shaped bed frame tubes 22, and the outer leg frames 33 are inserted into the end caps 60 and are pivoted to the U-shaped bed frame tubes 22 through the end caps 60 so as to be disposed on the U-shaped bed frame tubes 22 in a folding manner. Meanwhile, the outer leg frames 33 can be detached from the end caps 60 to be disassembled, so that replacement is facilitated. Clearly, in other embodiments, the outer leg frames 33 can also be directly pivoted to the U-shaped bed frame tubes 22.

Figure 2:
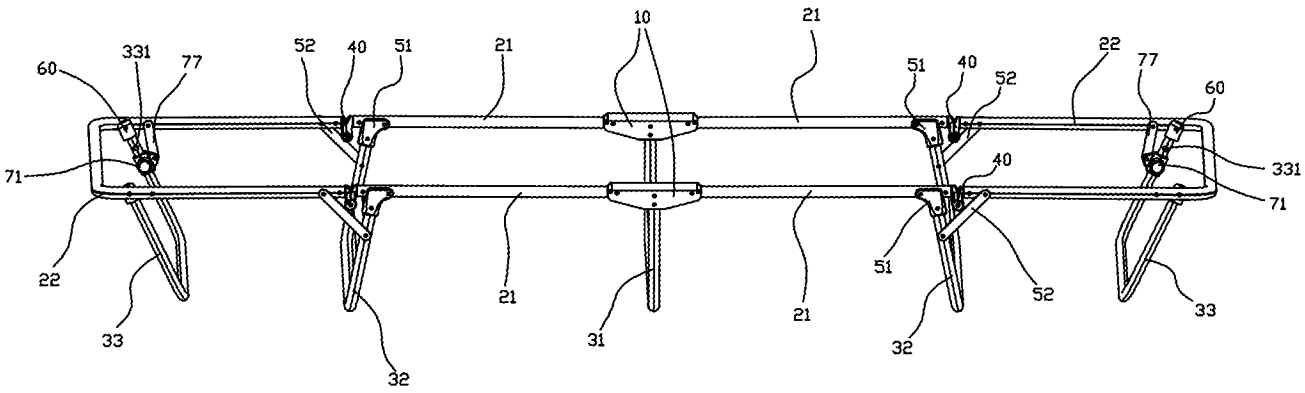
FIG. 2 is a first schematic diagram of the folding bedstead in the folding or unfolding process in the embodiment.
Figure 3:
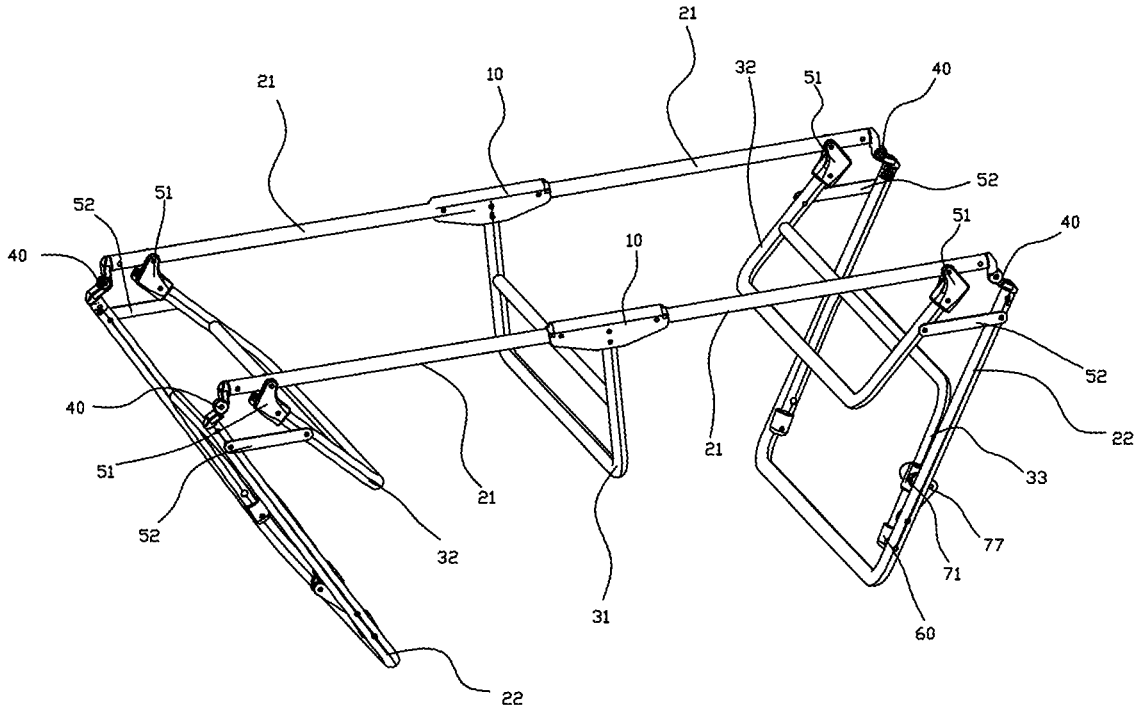
FIG. 3 is a second schematic diagram of the folding bedstead in the folding or unfolding process in the embodiment.
Figure 4:
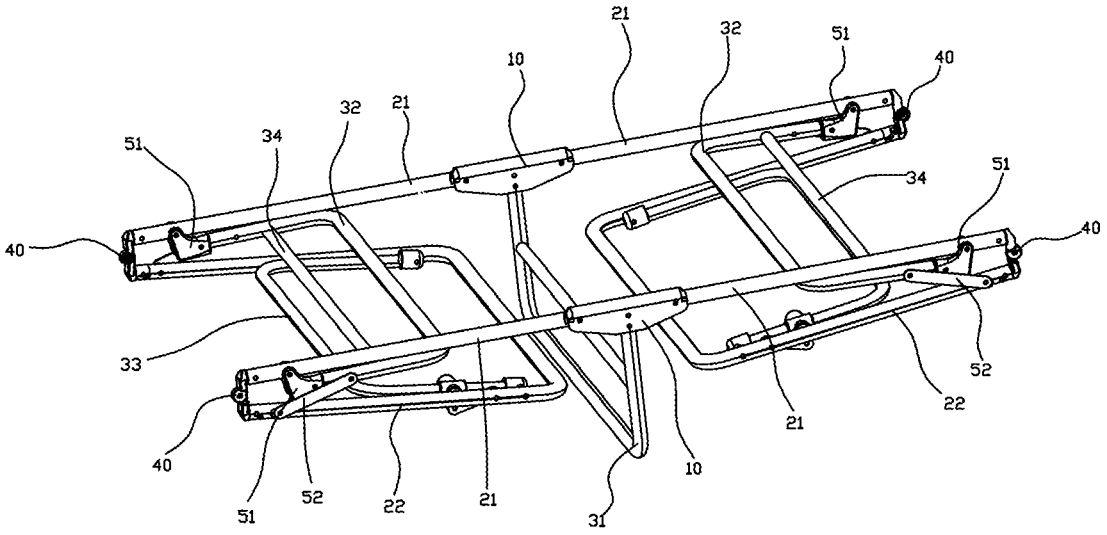
FIG. 4 is a third schematic diagram of the folding bedstead in the folding or unfolding process in the embodiment.
Figure 5:
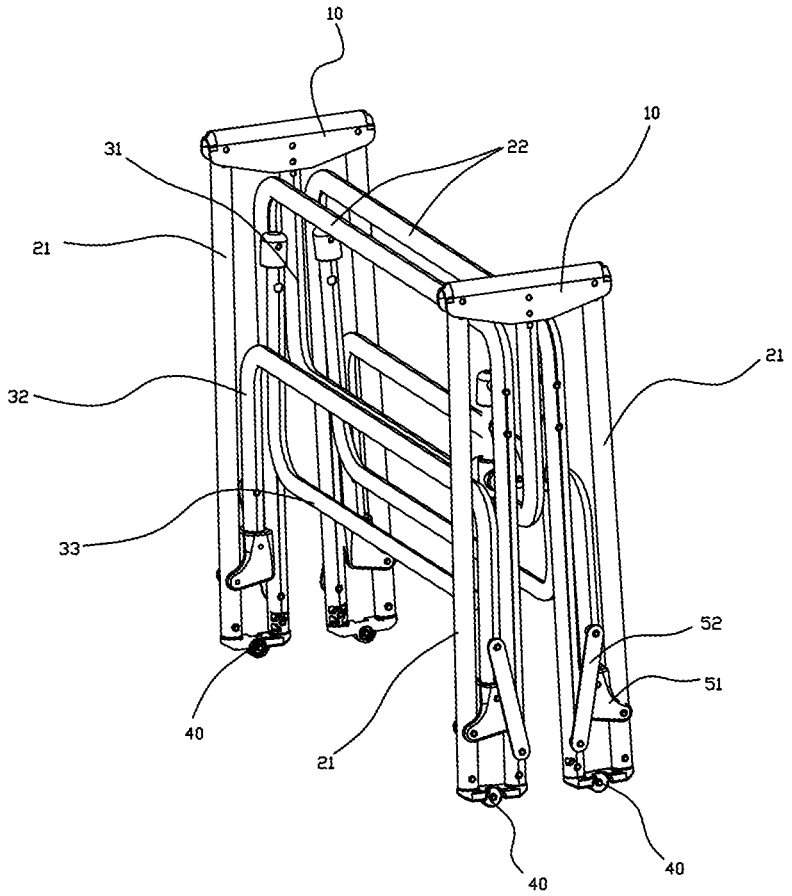
FIG. 5 is a structural diagram of the folding bedstead in a completely folded and stored state in the embodiment.
Figure 6:
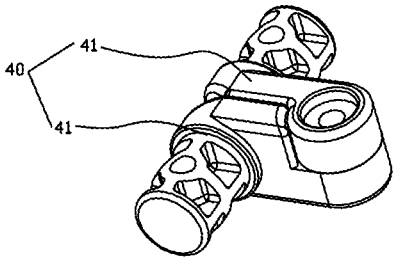
FIG. 6 is a structural diagram of a rotary connecting assembly in the embodiment.
Figure 7:
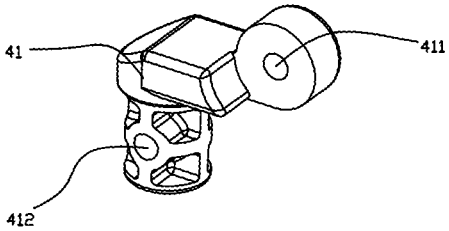
FIG. 7 is a structural diagram of one connecting component of the rotary connecting assembly in the embodiment.
Figure 8:
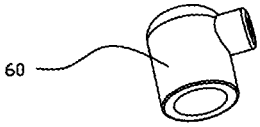
FIG. 8 is a structural diagram of an end cap in the embodiment.
Figure 9:
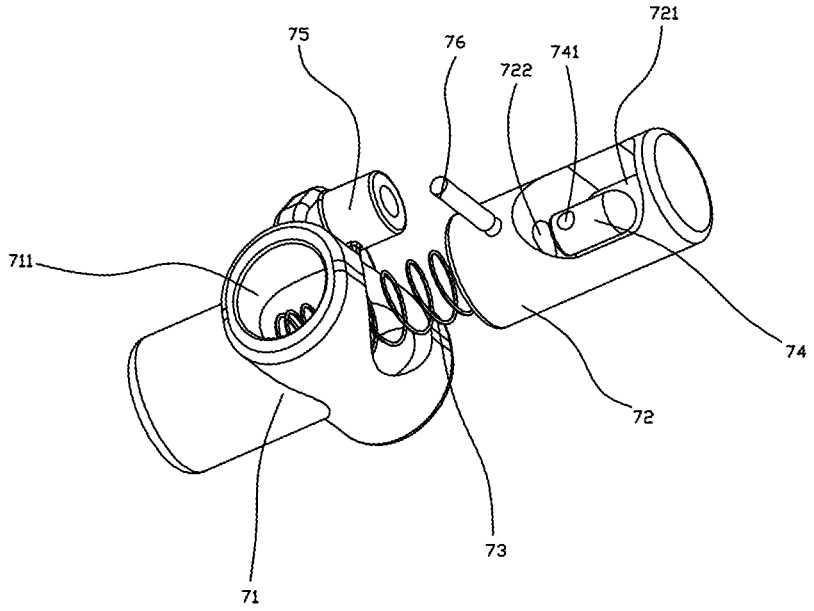
FIG. 9 is a partial exploded view of a lock device in the embodiment.
Figure 10:
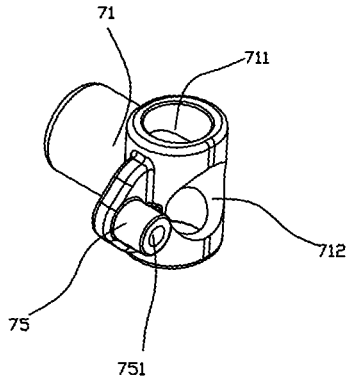
FIG. 10 is a structural diagram of a sleeve body of the lock device in the embodiment.
Figure 11:
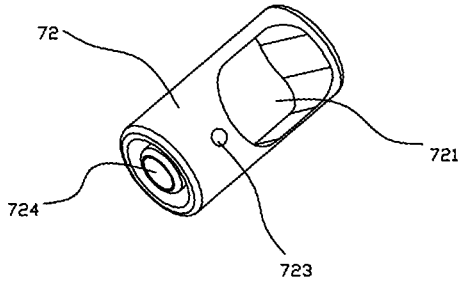
FIG. 11 is a structural diagram of an inner slider of the lock device in the embodiment.
Figure 12:
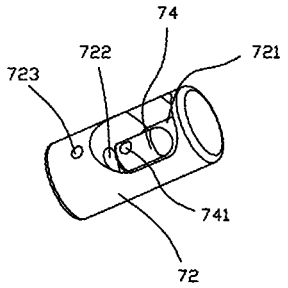
FIG. 12 is an exploded connection diagram of the inner slide and a bolt of the lock device in the embodiment.

Particularly, in this embodiment, each lock device comprises a sleeve body 71 provided with a sleeve hole 711, an inner slider 72, an elastic piece 73, and a second connecting piece 77, wherein an inner cavity which is perpendicular to the sleeve hole 711 and is provided with an opening 712 is formed in the sleeve body 71, and the inner slider 71 is arranged in the inner cavity in a sliding fit manner and is provided with a long slot 721 corresponding to the sleeve hole 711 and a bolt 74 stretching into the long slot 721; one outer leg frame 33 slidably penetrates through the sleeve hole 711 of the sleeve body 71 and the long slot 721 of the inner slider 72; two ends of the second connecting piece 77 are respectively pivoted to the sleeve body 71 and the corresponding U-shaped bed frame tube 22; each outer leg frames 33 is provided with a pin hole 331; the elastic piece 73 is arranged in the inner cavity; and when the sleeve body 71 slides to make the bolt 74 of the inner slider 72 correspond to the pin hole 331 of the outer leg frame 33, the elastic piece 73 drives the inner slider 72 to slide, then the bolt 74 is inserted into the pin hole 331 of the outer leg frame 33, the sleeve body 71 is fixed to the outer leg frame 33, and a stable triangular fixing structure is formed by the U-shaped bed frame tube 22, the outer leg frame 33 and the second connecting piece 77, and the relative positions of the outer leg frame 33 and the U-shaped bed frame tube 22 are locked. When the outer leg frames 33 and the U-shaped bed frame tubes 22 need to be unlocked, the inner sliders 72 are pressed to overcome an elastic force from the elastic pieces 73 to slide inwards, then the bolts 74 are disengaged from the pin holes 331 of the outer leg frames 33, and the sleeve bodies 71 and the outer leg frames 33 slide relatively again to complete unlocking, as shown in FIG. 2. By adoption of this structure, the relative positions of the outer leg frames 33 and the U-shaped bed frame tubes 22 can be locked or unlocked, and operation is easy and convenient. The lock device is arranged at one end of each outer leg frame 33, or the lock devices are arranged at both ends of each outer leg frame.

Particularly, the bolts 74 are detachably arranged on the inner sliders 72 and thus can be removed. Furthermore, bolt holes 722 and dowel holes 723 communicated with the bolt holes 722 are formed in the inner sliders 72, and the bolts 74 are provided with dowel holes 741; and the bolts 74 are inserted into the bolt holes 722 until the dowel holes 741 in the bolts 74 correspond to the dowel holes 723 in the inner sliders 72, and then dowels 76 penetrate through the dowel holes 741 in the bolts 74 and the dowel holes 723 in the inner sliders 72 to realize fixation.

Particularly, the elastic pieces 73 are springs, and protrusions 724 are formed at the ends of the inner sliders 72, and the springs 73 are disposed around the protrusions 724 to be positioned, so that connection is more accurate.

Particularly, protruding columns 75 are formed on the sleeve bodies 71 and are provided with connecting through holes 751 allowing the second connecting pieces 77 to be pivoted therein.

This embodiment further provides a folding bed. The folding bed comprises a bed surface and the folding bedstead mentioned above, wherein the bed surface is laid on the bed surface support frame of the folding bedstead.

Although the invention is specifically illustrated and introduced above in combination with the preferred embodiments, those skilled in the art would appreciate that various transformations of the invention can be made in form and in detail without deviating from the spirit and scope defined by the appended claims of the invention, and all these transformations should also fall within the protection scope of the invention.

What is claimed is:

1. A folding bedstead, comprising a bed surface support frame and a support leg frame, wherein the bed surface support frame comprises intermediate connecting pieces and support units symmetrically arranged at two ends of the intermediate connecting pieces, each said support unit comprises straight connecting tubes pivoted to the intermediate connecting pieces and a U-shaped bed frame tube pivoted to outer ends of the straight connecting tubes, and the bed surface support frame is a closed planar frame in an unfolded state; and the support leg frame comprises an intermediate leg frame, lateral leg frames, and outer leg frames, the intermediate leg frame is arranged on the intermediate connecting pieces, the lateral leg frames are arranged on the straight connecting tubes in a folding manner, and the outer leg frames are arranged on the U-shaped bed frame tubes in a folding manner;

wherein the outer leg frames are pivoted to the U-shaped bed frame tubes, and lock devices are arranged between the outer leg frames and the U-shaped bed frame tubes to lock relative positions of the outer leg frames and the U-shaped bed frame tubes;

wherein each said lock device comprises a sleeve body provided with a sleeve hole, an inner slider, an elastic piece and a second connecting piece, wherein the sleeve body is further provided with an inner cavity which is perpendicular to the sleeve hole and is provided with an opening, the inner slider is arranged in the inner cavity in a sliding fit manner and is provided with a long slot corresponding to the sleeve hole and a bolt stretching into the long slot, one said outer leg frame slidably penetrates through the sleeve hole of the sleeve body and the long slot of the inner slider, two ends of the second connecting piece are respectively pivoted to the sleeve body and the corresponding U-shaped bed frame tube, the outer leg frame is provided with a pin hole, and the elastic piece is arranged in the inner cavity; and when the sleeve body slides to make the bolt of the inner slider correspond to the pin hole of the outer leg frame, the elastic piece drives the inner slider to slide, and then the bolt is inserted into the pin hole of the outer leg frame, so that the relative positions of the outer leg frame and the U-shaped bed frame tube are locked.

2. The folding bedstead according to claim 1, wherein the intermediate leg frame, the lateral leg frames, and the outer leg frames are of a U-shaped structure and each comprise two vertical tubes having ends connected to the bed surface support frame and a horizontal tube connected between the two vertical tubes and supported on a ground.

3. The folding bedstead according to claim 2, wherein support connecting rods are connected between middle parts of the two vertical tubes of the intermediate leg frame and between middle parts of the two vertical tubes of each said lateral leg frame.

4. The folding bedstead according to claim 1, wherein each said intermediate connecting piece has an inverted U-shaped section and is provided with lateral openings formed in the ends of the intermediate connecting piece and a lower opening facing downwards, the straight connecting tubes at the two ends of the intermediate connecting pieces stretch into the intermediate connecting pieces via the lateral openings to be pivoted to the intermediate connecting pieces, and the intermediate leg frame stretches into the intermediate connecting pieces via the lower openings to be fixed to the intermediate connecting pieces.

5. The folding bedstead according to claim 1, wherein rotary bases are pivoted to the straight connecting tubes, and the lateral leg frames are fixedly connected to the rotary bases; the folding bedstead further comprises first connecting pieces, and two ends of each said first connecting piece are respectively pivoted to one said lateral leg frame and the corresponding U-shaped bed frame tube; and when the bed surface support frame is unfolded, stable triangular fixing structures are formed by the first connecting pieces, the lateral leg frames, and the U-shaped bed frame tubes.

6. The folding bedstead according to claim 1, wherein the straight connecting tubes are pivoted to the U-shaped bed frame tubes through rotary connecting assemblies; and each said rotary connecting assembly is composed of two connecting components which are of a 7-shaped structure and are arranged oppositely, wherein outer ends of the two connecting components are pivoted together, and outer ends of the two connecting components are respectively connected with one said straight connecting tube and the corresponding U-shaped bed frame tube.

7. The folding bedstead according to claim 6, wherein the ends of the connecting components of the rotary connecting assemblies are inserted into the straight connecting tubes and/or the U-shaped bed frame tubes to be fixed.

8. A folding bed, comprising a folding bedstead and a bed surface laid on the folding bedstead, wherein the folding bedstead is the folding bedstead according to claim 1.

9. The folding bed according to claim 8, wherein the intermediate leg frame, the lateral leg frames, and the outer leg frames are of a U-shaped structure and each comprise two vertical tubes having ends connected to the bed surface support frame and a horizontal tube connected between the two vertical tubes and supported on a ground.

10. The folding bed according to claim 9, wherein support connecting rods are connected between middle parts of the two vertical tubes of the intermediate leg frame and between middle parts of the two vertical tubes of each said lateral leg frame.

11. The folding bed according to claim 8, wherein each said intermediate connecting piece has an inverted U-shaped section and is provided with lateral openings formed in the ends of the intermediate connecting piece and a lower opening facing downwards, the straight connecting tubes at the two ends of the intermediate connecting pieces stretch into the intermediate connecting pieces via the lateral openings to be pivoted to the intermediate connecting pieces, and the intermediate leg frame stretches into the intermediate connecting pieces via the lower openings to be fixed to the intermediate connecting pieces.

12. The folding bed according to claim 8, wherein rotary bases are pivoted to the straight connecting tubes, and the lateral leg frames are fixedly connected to the rotary bases; the folding bedstead further comprises first connecting pieces, and two ends of each said first connecting piece are respectively pivoted to one said lateral leg frame and the corresponding U-shaped bed frame tube; and when the bed surface support frame is unfolded, stable triangular fixing structures are formed by the first connecting pieces, the lateral leg frames, and the U-shaped bed frame tubes.

13. The folding bed according to claim 8, wherein the straight connecting tubes are pivoted to the U-shaped bed frame tubes through rotary connecting assemblies; and each said rotary connecting assembly is composed of two connecting components which are of a 7-shaped structure and are arranged oppositely, wherein outer ends of the two connecting components are pivoted together, and outer ends of the two connecting components are respectively connected with one said straight connecting tube and the corresponding U-shaped bed frame tube.

14. The folding bed according to claim 13, wherein the ends of the connecting components of the rotary connecting assemblies are inserted into the straight connecting tubes and/or the U-shaped bed frame tubes to be fixed.

* * * * *